United States Patent [19]

Ridley

[11] 4,007,963

[45] Feb. 15, 1977

[54] OIL COLLECTION AND RECOVERY SYSTEM FOR IN SITU OIL SHALE RETORT

[75] Inventor: Richard D. Ridley, Grand Junction, Colo.

[73] Assignee: Occidental Petroleum Corporation, Los Angeles, Calif.

[22] Filed: Mar. 30, 1976

[21] Appl. No.: 671,957

Related U.S. Application Data

[63] Continuation of Ser. No. 578,258, May 16, 1975, abandoned.

[52] U.S. Cl. ..... 299/2; 166/259; 166/260; 166/303; 208/8

[51] Int. Cl.[2] ..... E21B 43/24; E21B 43/26; E21C 41/10

[58] Field of Search ..... 299/2, 3, 4, 14; 166/256, 259, 260, 303

[56] References Cited

UNITED STATES PATENTS

| | | | |
|---|---|---|---|
| 1,269,747 | 6/1918 | Rogers | 299/2 |
| 1,418,098 | 5/1922 | Schneiders | 299/2 |
| 1,804,692 | 5/1931 | Jackson | 299/2 |
| 2,210,582 | 8/1940 | Grosse et al. | 299/2 |
| 2,481,051 | 9/1949 | Uren | 299/2 |
| 2,630,306 | 3/1953 | Evans | 299/4 X |
| 3,362,751 | 1/1968 | Tinlin | 299/2 |
| 3,601,193 | 8/1971 | Grady | 166/259 X |
| 3,661,423 | 5/1972 | Garret | 299/2 |

FOREIGN PATENTS OR APPLICATIONS

| | | | |
|---|---|---|---|
| 812,573 | 9/1951 | Germany | 299/2 |

*Primary Examiner*—Stephen J. Novosad
*Assistant Examiner*—George A. Suchfield
*Attorney, Agent, or Firm*—Christie, Parker & Hale

[57] ABSTRACT

An in situ oil shale retort is provided with a sealed space at the bottom in which liquids produced in the in situ retort and retort off gases are separated. The separated liquids and retort off gases are removed from the sealed space through a bulkhead provided in an access tunnel leading to the sealed space which can be a portion of the tunnel. A sump is provided in the floor of the access tunnel inside the sealed space for collecting liquids. Trenches extending from the bottom of the in situ retort into the sump are provided for directing liquids from the in situ retort to the sump. The trenches are backfilled with large shale particles to prevent blocking of the trenches when the oil shale in the retort is explosively fragmented. Conduits extending through the bulkhead and into the sealed space are provided for removing liquids from the sump and retort off gases from the sealed space above the liquid level.

16 Claims, 2 Drawing Figures

OIL COLLECTION AND RECOVERY SYSTEM FOR IN SITU OIL SHALE RETORT

This is a continuation of application Ser. No. 578,258, filed May 16, 1975, now abandoned.

FIELD OF INVENTION

This invention relates to in situ retorting of oil shale, and more particularly, is concerned with separation of retort off gases and liquids produced in the situ retort.

BACKGROUND OF THE INVENTION

In U.S. Pat. No. 3,661,423, assigned to the same assignee as the present invention, there is described an in situ oil shale retorting process. An in situ oil shale retort is a cavity formed in essentially undisturbed walls of oil shale and filled with fragmented oil shale. That patent describes one way of forming an in situ oil shale retort, namely by mining a lower portion of the oil shale formation and then explosively expanding the overlying oil shale to form a large cavity and simultaneously fill it with fragmented oil shale. Other techniques may be suitable for forming an in situ oil shale retort. Kerogen in oil shale in the in situ retort is converted to liquids and product gases by advancing a retorting zone through the in situ retort. The retorting zone can be advanced from the top to the bottom of the in situ retort and the liquids and retort off gases produced can be removed through an access tunnel leading to the bottom of the in situ retort.

SUMMARY OF THE INVENTION

The present invention is directed to an in situ oil shale retort in which liquids produced in the in situ retort and retort off gases can be separated. These products are removed through a bulkhead provided in an access to a sealed space having a sump for collecting the liquids produced in the in situ retort. In one embodiment this is accomplished by providing a gas-tight bulkhead in an access tunnel to the bottom of an in situ retort and a sump in the floor of the access tunnel near the bulkhead, the sump being between the bulkhead and the in situ retort. The sump is spaced a sufficient distance from the entrance of the tunnel to the in situ retort that particles of oil shale fragmented during the formation of the in situ retort do not reach the sump. While the floor of the in situ retort may be sloped toward the tunnel during excavation to provide for flow of liquids toward the sump, it is preferred to form one or more trenches extending from low points in the floor of the in situ retort into the tunnel and to the sump. The trenches are sloped slightly downwardly in the direction of the sump to provide for gravity flow of liquids from the in situ retort to the sump and are filled with rocks which prevent the trenches from becoming blocked with oil shale particles during blasting to form the in situ retort. Liquids produced in the in situ retort are withdrawn from the sump through a conduit extending through the bulkhead and into the sump. Retort off gases are withdrawn through a conduit extending through the bulkhead for collection or retort off gases above the level of liquids in the sealed space.

DESCRIPTION OF THE DRAWINGS

For a more complete understanding of the invention, reference should be made to the accompanying drawings of a presently preferred embodiment wherein.

DETAILED DESCRIPTION

Figure 1:
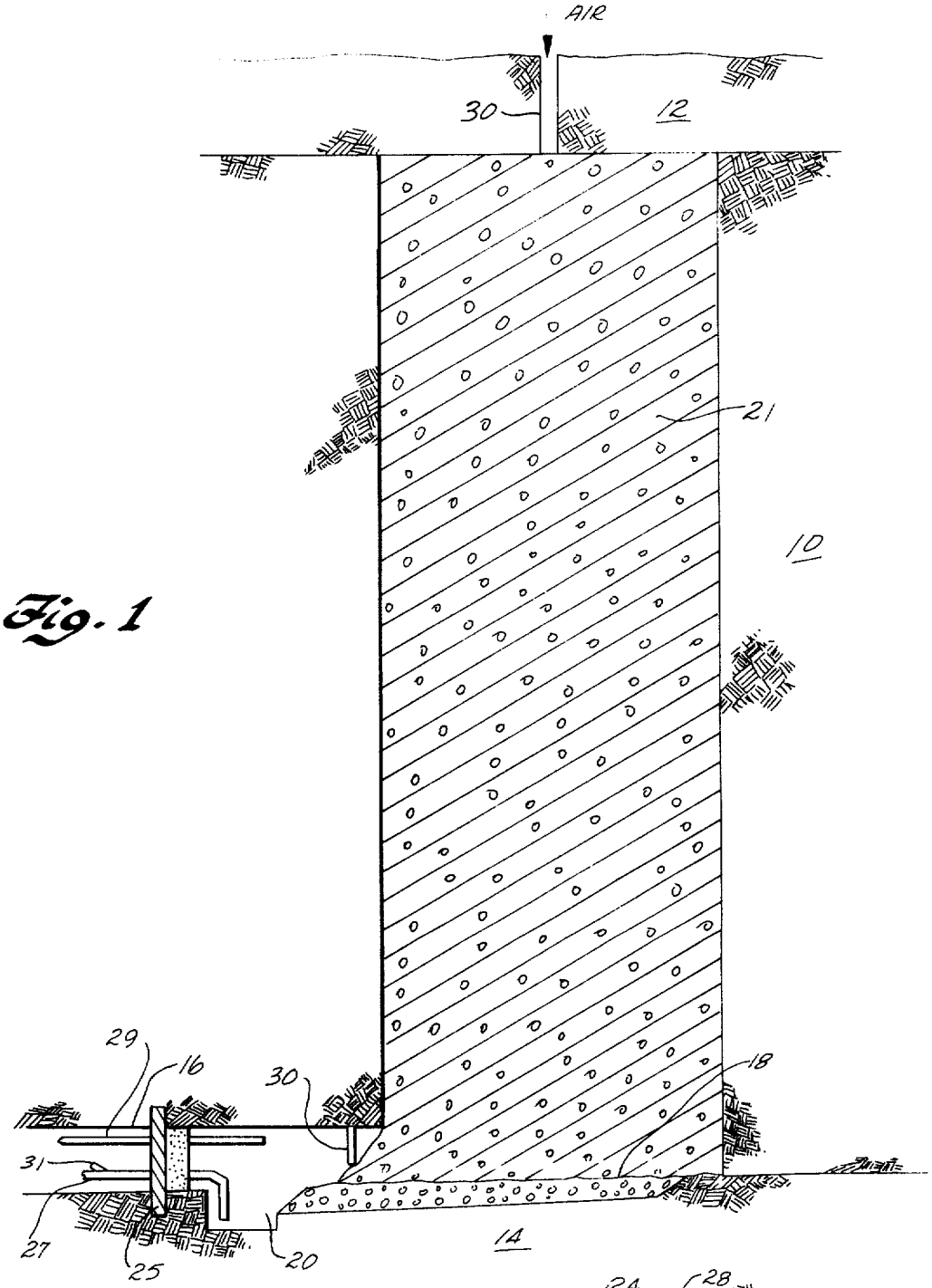
FIG. 1 is a schematic sectional view of an in situ retort for oil shale incorporating features of the present invention.

Referring to the drawings in detail, the numeral 10 indicates generally a subsurface formation of oil shale which typically might be 50 to 1000 ft. in thickness. An overburden 12 of rock lies between the top of the oil shale formation and the ground surface. The underlying rock 14 extends below the oil shale formation. It is preferred that the in situ oil shale retort extend the full height of the oil shale formation so that maximum amount of shale oil can be recovered therefrom. In some embodiments the retort may extend for less than the full height of the formation because of factors of no importance in practice of this invention. In other embodiments the top or bottom of the in situ retort may be in rock outside of the oil shale formation. For purposes of exposition herein, the height of the in situ retort illustrated in FIG. 1 corresponds to the full height of the oil shale formation 10.

To form the in situ retort illustrated in FIG. 1, an access tunnel 16 in communication with the ground surface directly or by way of a shaft is excavated at the bottom of the oil shale formation. A portion of the oil shale is excavated over all or some of a suitable region, for example, 35 to 120 ft. square, adjacent the bottom of the oil shale formation. The floor 18 of the excavated region is sloped slightly downwardly toward the tunnel 16 to provide drainage into a sump 20 excavated in the floor of the access tunnel. The oil shale from the excavated region is removed through the tunnel 16. However, unless extensive chipping and smoothing work is done, the floor 18 may have substantial depressions and ridges formed as a result of the blasting and excavation operations.

Figure 2:
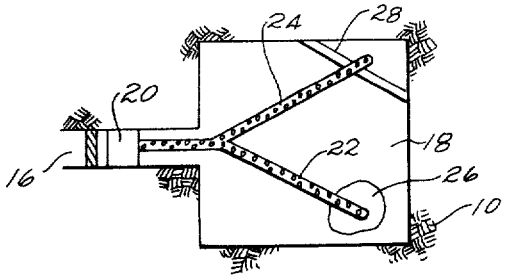
FIG. 2 is a plan view of the floor of the in situ retort.

In practice of the present invention, to avoid smoothing and shaping of the floor 18 and yet provide complete drainage and avoid accumulation of appreciable amounts of liquid within the in situ retort, one or more trenches, two of which are indicated at 22 and 24 in FIG. 2, are formed in the floor 18 of the excavated region. The trenches extend from the larger depressed areas in the floor, such as indicated at 26, or from areas separated from the access tunnel by a ridge, such as indicated at 28. The trenches can be cut in the rock floor of the excavated region by conventional techniques, such as mechanical cutting or blasting. The trenches are desirably made relatively narrow, so that the bottom of the trenches can easily be made uniform and formed with a gradual slope of the order of ½% grade or more extending into the sump.

The trenches are then filled with rubble consisting of fairly large shale particles. If desired additional large shale particles can be piled over the trenches or other areas of the floor. Shale particles having diameters of five to ten inches and relatively free of fine particles are desirable for filling the trenches while providing sufficient interconnected open spaces between the shale particles in the trenches for free flow of liquids through the trenches. Backfilling the trenches with sized rubble prevents fragmented oil shale formed during the formation of the in situ retort from blocking the trenches and preventing liquid flow therethrough.

The in situ retort is then formed by placing explosives in the oil shale formation above the excavated region in a pattern such that when the explosives are detonated, the overlying oil shale is fragmented into relatively small pieces to form an enclosed volume of fragmented oil shale 21 within the oil shale formation. Thus, the in situ oil shale retort has boundaries of essentially undisturbed or unfragmented oil shale containing oil shale fragments produced by blasting. The fragmented oil shale substantially fills the volume from which it is formed, plus the excavated region at the bottom. The in situ oil shale retort can be formed by any of a variety of techniques having no effect on practice of this invention. One technique is described, for example, in U.S. Pat. No. 3,661,423.

Before the explosives are detonated, the sump 20 is excavated in the floor of the access tunnel 16. The sump 20 is spaced away from the excavated region in the volume to become the in situ retort far enough to be out of reach of the normal fall of the fragmented oil shale into the tunnel when the explosives are detonated. Thus the sump remains substantially clear of fragmented oil shale from the in situ retort. If desired, the sump can be excavated after the oil shale in the retort is blasted, but this complicates formation of the trenches.

After fragmenting the oil shale to form the in situ oil shale retort, a bulkhead 25 is positioned in the tunnel 16 to separate the remainder of the access tunnel from the in situ retort. The bulkhead is anchored in the floor, walls, and ceiling of the access tunnel to form a substantially gas-tight barrier. The steel bulkhead can be anchored to the floor, walls, and ceiling of the access tunnel with cement. The bulkhead 25 may be provided with a hatch (not shown) to permit entrance to the sealed space adjacent the in situ retort. The inside of the steel bulkhead 25 is then lined with firebrick or other suitable heat-resistant material to insulate the bulkhead from high temperatures produced within the in situ retort during the retorting process. A fire wall may also be placed away from the bulkhead or may be between the sump and the in situ retort if adequate fluid flow passages are provided and the trenches are not thereby blocked.

In order to remove the liquids such as shale oil and water which accumulate in the sump 20 during the retorting process, a conduit 27 is provided with extends through the bulkhead 25 and part way down into the sump 20. The conduit preferably extends through the tunnel 16 to the ground surface. Suitable pumping equipment (not shown) is used for withdrawing liquids from the sump and moving the liquids through the conduit 27 to the surface. Since both water and shale oil accumulate in the sump during the retorting process, the conduit 27 preferably extends only part way between the top and bottom of the sump 20 so that the shale oil can be withdrawn from the sump without withdrawing water accumulated at the bottom of the sump. A separate conduit (not shown) may be provided for withdrawing water through the bulkhead and from the bottom of the sump. If desired, both water and shale oil can be withdrawn through a single conduit and separated outside of the bulkhead. The liquids can be withdrawn continually, or conventional floats or other sensors can be provided in the sump so that liquids can be withdrawn intermittently. Preferably an opening 31 such as a Y, is provided in the liquid conduit so that it can be cleaned out if plugged during retorting.

In addition to the conduit 27, a large diameter gas conduit 29 extends through the bulkhead 25 between the sealed space and the balance of the access tunnel. The gas conduit 29 has a gas collecting opening above the liquid level in the sump for withdrawing retort off gas from the in situ retort. It is convenient to locate the gas conduit 29 near the ceiling to avoid interference with other conduits and provide adequate working room. It is only important that the gas conduit be above the sump to avoid accidental withdrawal of liquids through the gas conduit. Preferably the gas conduit 29 is connected to an exhaust fan or pump so that withdrawal of retort off gas from the bottom of the retort is aided and there is little danger of the retort off gas escaping into the tunnel 16 outside of the bulkhead.

In addition to spacing the sump 20 well away from the in situ retort beyond the normal fall of fragmented oil shale from the in situ retort, a suitable baffle 30 may be provided in the tunnel 16 between the sump and the in situ retort. The baffle 30 (which may be old crawler tractor treads) is suspended from the ceiling of the tunnel and is spaced above the floor of the tunnel, permitting liquids and gases to flow underneath the baffle. The baffle acts to protect the conduits and sump from pieces of fragmented oil shale thrown into the tunnel when the explosives are detonated during formation of the in situ retort. With the trenches from the excavated region formed with a downward slope in the direction of the sump 20, liguids which are formed during the retorting process flow from the in situ retort along the tunnel and into the sump, from which they are withdrawn through the conduit 27.

The fragmented oil shale in the in situ oil shale retort is retorted by advancing a retorting zone from the top to the bottom of the in situ retort by gas introduced through a conduit 40 at the top. Liquids, such as shale oil and water, are collected in the sump 20 in the sealed area between the bulkhead 25 and the in situ retort 21 and are withdrawn through the bulkhead through the liquid conduit 27. Off gas is withdrawn through the larger gas conduit 29.

In one embodiment of this invention, a square in situ oil shale retort is formed in a subterranean oil shale formation. An access tunnel is driven into the oil shale formation and a square room extending from the access tunnel is excavated in the volume of the oil shale formation to become the in situ retort. The room is about 35 feet square, and has a height of about 20 feet. The floor of the room is approximately horizontal and on about the same horizontal level as the floor of the access tunnel. Trenches having widths of about 2 feet and bottoms sloping toward the tunnel are excavated from low points in the floor of the in situ retort to the area where a sump is to be formed in the floor of the tunnel. The trenches are filled with irregular oil shale particles having diameters of about 5 to 10 inches. The sump is excavated in the tunnel with the in situ retort side of the sump being about 20 feet or more from the entrance to the room to prevent fragmented oil shale from filling the sump when the oil shale is blasted to form the in situ oil shale retort.

Explosives are then placed in the oil shale formation above the room for expanding the oil shale and filling room and resulting in situ retort with fragmented oil shale. The explosives are detonated to fragment the oil shale and from the in situ retort. A bulkhead with a hatch is anchored in the access tunnel about 10 feet from the tunnel side of the sump to provide a sealed space connected to the in situ oil shale retort. Liquid removal conduits are welded or otherwise sealed through the bulkhead and dip into the sump. A retort off gas removal conduit is also welded through the bulkhead and provided with an opening for collecting retort off gas from the space above the top of the sump. A conduit is also provided for introducing retorting gas to the top of the in situ oil shale retort.

A combustible mixture of fuel and an oxygen supplying gas is introduced to the top of the in situ retort and is ignited to form a combustion zone at the top of the in situ retort. A supply of the combustible mixture is maintained at the top of the in situ retort to supply fuel and oxygen to the combustion zone for about 1 week. At the end of about 1 week, the supply of fuel to the combustion zone is terminated and a supply of oxygen supplying gas, such as air or air diluted with off gas, is supplied to the combustion zone. Oxygen reacts with carbonaceous material in shale in the in situ retort which has been heated to 900° F. or more by previous combustion, and supplies additional heat to the in situ retort. As the inlet gas moves through the combustion zone, oxygen is depleted and the gas is heated. As the gas moves downwardly from the combustion zone heat is transferred from the combustion zone to the fragmented oil shale below it, to form a retorting zone where the shale is heated to a sufficient temperature for retorting. Kerogen in oil shale in the retorting zone in the in situ retort is converted to liquid such as shale oil and water, and product gases. As the gas moves through the in situ retort, it becomes a mixture of flue gases from the combustion zone and product gases from the retorting zone which are carried through the in situ retort to the sealed space connected to the bottom of the in situ retort. These retort off gases are withdrawn from the sealed space through the gas conduit extending through the bulkhead. The liquids produced in the rotating zone percolate downwardly through the in situ retort, flow through the trenches in the floor, and are collected in the sump provided in the sealed space connected to the in situ retort. The liquids are removed from the sump through the liquid removal conduit extending through the bulkhead.

It will be understood by those skilled in the art that considerable variations in the in situ retort and methods of the present invention are permissible, and the invention is not to be limited to the specific embodiments which are given herein for the purpose of disclosure.

What is claimed is:

1. An in situ oil shale retort in a subterranean oil shale formation containing a volume of fragmented oil shale and having an access tunnel at the bottom of the in situ retort, which comprises:

a gas-tight bulkhead means in the access tunnel for providing a sealed space connected to the bottom of the in situ retort;

a sump in said sealed space for collecting liquids from the in situ retort;

at least one trench extending from at least one low point in the bottom of the in situ retort to said sump for directing liquid from the bottom of the in situ retort into said sump;

a conduit extending through said bulkhead means and into said sump for withdrawing liquids from said sump; and a conduit extending through said bulkhead means and into the sealed space with an opening above the sump for removing gas from the in situ retort.

2. An in situ oil shale retort as recited in claim 1 wherein such a trench is filled with large formation particles having a size distribution which will permit the flow of liquids through such a trench.

3. An in situ oil shale retort as recited in claim 1, which further comprises a plurality of trenches extending from low points in the bottom of the in situ retort to said sump.

4. An in situ oil shale retort as recited in claim 3 wherein the bottom of said trenches slope toward said sump.

5. An in situ oil shale retort as recited in claim 1 wherein said sump is spaced a sufficient distance from the in situ retort that fragmented oil shale from the in situ retort does not fall into said sump.

6. A method of converting kerogen in fragmented oil shale in an in situ oil shale retort in a subterranean oil shale formation to liquids and product gases, said in situ oil shale retort having an access tunnel extending into the bottom of the in situ oil shale retort, a bulkhead means for providing a sealed space in the tunnel at the bottom of the in situ oil shale retort, a sump in the sealed space outside of the in situ retort and in the access tunnel, at least one trench in the bottom of the in situ oil shale retort extending to the sump, and means for withdrawing liquids and product gases through the bulkhead means, which comprises the steps of:

fragmenting subterranean oil shale formation to form an in situ oil shale retort having boundaries of subterranean oil shale formation and containing fragmented oil shale;

heating the fragmented oil shale in an upper portion of the in situ retort to a sufficient temperature to produce a retorting zone wherein fragmented oil shale is retorted to convert kerogen in the fragmented oil shale to liquids and product gases in the in situ retort;

advancing said retorting zone toward the bottom of the in situ retort to convert the kerogen in fragmented oil shale in the in situ retort to liquids and product gases;

directing said liquids through such a trench in the bottom of the in situ retort to the sump excavated in the sealed space outside the in situ retort and in the access tunnel at the bottom of the in situ retort; and withdrawing product gases and said liquids through said bulkhead means.

7. A method as recited in claim 6 further comprising the step of backfilling such a trench in the bottom of the in situ retort with particles of subterranean formation before the fragmenting step.

8. A method of forming an in situ oil shale retort containing a volume of fragmented oil shale in a subterranean oil shale formation comprising the steps of:

excavating subterranean formation to form an access tunnel to a lower portion of the in situ oil shale retort being formed;

excavating subterranean formation to form an excavated region in communication with the access tunnel at the lower portion of the in situ oil shale retort being formed;

excavating subterranean formation to form a pump in the floor of the access tunnel outside of the excavated region;

forming at least one trench in the floor of the excavated region extending from a low area in the floor to the sump, such a trench sloping downwardly toward the sump; and blasting subterranean oil shale formation from above the excavated region toward the excavated region to form a volume of fragmented oil shale in the in situ oil shale retort being formed.

9. A method as recited in claim 8 further including the step of filling such a trench with subterranean formation particles before blasting the subterranean formation containing oil shale for preventing such a trench from becoming blocked by particles of fragmented oil shale formed by the blasting.

10. A method for recovering liquids from an in situ retort forming in accordance with the method of claim 9 further comprising the steps of:

providing a gas-tight bulkhead means in the access tunnel on the opposite side of the sump from the in situ retort;

passing a retorting gas through the retort for releasing liquids and product gases from the oil shale;

flowing at least a portion of said liquid through such a trench to the sump; and withdrawing said liquids from the sump through the bulkhead means.

11. A method as defined in claim 10 further comprising the step of withdrawing product gases through the bulkhead means from a portion of the access tunnel above the liquid level in the sump.

12. An in situ oil shale retort in a subterranean oil shale formation comprising an enclosed volume of particles of fragmented oil shale in the oil shale formation, the in situ oil shale retort having a floor, a tunnel connected to the enclosed volume adjacent the floor of the in situ retort, the tunnel having a depressed area extending below the level of the floor and forming a sump, and at least one trench formed in the floor of the in situ retort extending into the sump, the bottom of such a trench sloping downwardly toward the sump.

13. An in situ retort as recited in claim 12 wherein the trench is filled with particles of subterranean formation relatively free of fine particles for providing sufficient interconnected open spaced between the particles for flow of liquids through such a trench.

14. An in situ retort as recited in claim 13 wherein such a trench extends from a depressed region in the floor of the in situ retort to the sump.

15. An in situ retort as recited in claim 13 including a plurality of trenches in the floor of the in situ retort leading downwardly toward the sump.

16. An in situ retort as defined in claim 12 further comprising a gas-tight bulkhead means in the tunnel on the opposite side of the sump from the in situ retort, means for withdrawing liquids from the sump, and a gas conduit means having an opening above the sump for withdrawing retorting off gas from the in situ retort.

* * * * *